US007810681B2

(12) United States Patent
Lohrman et al.

(10) Patent No.: US 7,810,681 B2
(45) Date of Patent: Oct. 12, 2010

(54) INTERNAL CONTAINER BORE MOUNT FITMENT

(75) Inventors: Richard D. Lohrman, Aurora, IL (US); Thomas Hennessy, Naperville, IL (US); Sungsuk Steve Kim, Batavia, IL (US)

(73) Assignee: Portola Packaging, Inc., Batavia, IL (US)

( * ) Notice: Subject to any disclaimer, the term of this patent is extended or adjusted under 35 U.S.C. 154(b) by 0 days.

(21) Appl. No.: 12/520,459

(22) PCT Filed: Dec. 21, 2007

(86) PCT No.: PCT/US2007/088538

§ 371 (c)(1),
(2), (4) Date: Sep. 25, 2009

(87) PCT Pub. No.: WO2008/080053

PCT Pub. Date: Jul. 3, 2008

(65) Prior Publication Data

US 2010/0012687 A1 Jan. 21, 2010

Related U.S. Application Data

(60) Provisional application No. 60/871,723, filed on Dec. 22, 2006.

(51) Int. Cl.
*B65D 47/10* (2006.01)

(52) U.S. Cl. ..... 222/541.9; 220/258.2; 215/255

(58) Field of Classification Search ..... 222/541.9, 222/541.1, 541.4, 541.6, 491, 492, 546; 215/255–257; 220/258.2, 258.3, 269–270, 276
See application file for complete search history.

(56) References Cited

U.S. PATENT DOCUMENTS

| | | | | | |
|---|---|---|---|---|---|
| 3,341,046 | A * | 9/1967 | Bereziat et al. | 215/307 |
| 3,860,152 | A * | 1/1975 | Marti | 222/545 |
| 4,512,486 | A * | 4/1985 | Kobayashi et al. | 215/249 |
| 4,643,329 | A * | 2/1987 | Mobberley et al. | 220/257.2 |
| 5,810,207 | A * | 9/1998 | Hayashida | 222/153.07 |
| 5,992,659 | A * | 11/1999 | Nofer et al. | 215/235 |
| 6,776,314 | B2 * | 8/2004 | Odet | 222/541.5 |
| 6,883,689 | B2 * | 4/2005 | Odet | 222/541.9 |
| 7,559,432 | B2 * | 7/2009 | Mavin et al. | 220/258.2 |
| 2005/0092750 | A1 * | 5/2005 | Lohrman et al. | 220/258.2 |
| 2008/0272084 | A1 * | 11/2008 | Lohrman et al. | 215/255 |

FOREIGN PATENT DOCUMENTS

| | | | | |
|---|---|---|---|---|
| DE | 10160362 | * | 6/2003 | 222/541.9 |
| JP | 9-142512 | * | 6/1997 | 215/256 |
| JP | 2002-37296 | * | 2/2002 | 215/256 |

* cited by examiner

*Primary Examiner*—Lien T Ngo
(74) *Attorney, Agent, or Firm*—James P. Hanrath; Adam K. Sacharoff

(57) ABSTRACT

In an embodiment of the invention there is provided a membrane fitment designed and sized to be inserted into the orifice defined by a container. Retention structure on the fitment cooperates with complimentary structure on the internal wall of the container orifice to secure the fitment within the orifice such that the combination forms an excellent primary seal. Tamper evidence is offered by the normal requirement for initial membrane removal. Novel designs for the membrane, its associated pull ring, and the frangible removal structure are taught in various embodiments. The novel designs may promote facile initial removal suitable for a child. In addition, the novel designs avoid the potential hazards presented by prior art membranes.

23 Claims, 9 Drawing Sheets

INTERNAL CONTAINER BORE MOUNT FITMENT

CROSS-REFERENCE TO RELATED APPLICATIONS

This application claims priority to U.S. Provisional Patent Application 60/871,723 filed Dec. 22, 2006 and PCT/US07/88538 filed Dec. 21, 2007.

TECHNICAL FIELD

One or more embodiments contained within this invention relate to dispensing fitments, and particularly to, dispensing fitments with a removable membrane used with containers to dispense liquids contained therein.

BACKGROUND ART

Dispensing fitments have become commonplace in the packaging of many liquids and some solids. Commonly, some fitments may be attached to the sidewall of a container, which in some instances are made from paperboard. In these cases the fitment surrounds an orifice in the container wall and includes an upstanding spout to facilitate dispensing of the contents. The internal bore of the spout is initially closed by a membrane attached to the sidewall of the spout through a frangible line of weakness. On initial opening, a consumer grasps a "pull ring" attached to the membrane and pulls. This action results in removal of the membrane along the line of weakness and thereby clears a substantial portion of the bore for dispensing. It is noted that the initial intact membrane serves not only as a primary seal but also a tamper evidencing function. A quintessential example of such a "removable membrane" fitment is taught in U.S. Pat. No. 5,810,184 to Adams et. al.

Such removable membrane fitments have been marketed for many years. However, their market presence increased dramatically during the decade of 1990 due to their use on the classic "gable top" liquid packaging. This packaging development was enthusiastically received by the consuming public by improving product dispensing from an historically unwieldy package. More recently, similar removable membrane fitments have been employed with bottles. In these applications, the fitments are formed with structure designed to engage complimentary "fitment engaging structure" positioned on the exterior surface of the bottle neck. The removable membrane fitment offers widely recognized and accepted tamper evidencing function and potentially improves sealing and freshness in a way which is easily recognized and understood by the consumer. Embodiments of "removable membrane" fitments designed for use in conjunction with bottles are taught in U.S. patent application Ser. No. 10/854,925 to Lohrman et al.

Despite their success and consumer acceptance, some aspects of the removable membrane closures remain troublesome in both paperboard and bottle applications. One such aspect involves the use of an additional overcap that normally accompanies the fitment to provide a reseal capability once the membrane is removed. This overcap is of course a second piece to the closure system which must be assembled to the fitment prior to application of the assembly to the container. The overcap adds considerably to the cost of the closure.

An additional problem is that variations in manufacture occasionally result in the frangible removable membrane being tougher than desired, resulting in excessive removal forces associated with initial membrane removal. The pull ring integrity can also be dependent on the direction of pull. The combination of these conditions results in the possibility of the pull ring breaking away prematurely, leaving the frangible line intact with the entire membrane or a portion thereof still attached to the side wall of the spout.

An additional concern with conventional removable membrane fitment designs is that the internal bore involved is often in the range of about 20 mm to 38 mm. The membrane when removed results in a disk shaped piece of about 20 mm to 38 mm. This could present a choking hazard when handled by children. Fortunately, this has not been a practical concern, since most removable membrane closures have been used on larger packaging not independently consumed by unsupervised children.

In another segment of liquid packaging, developed for health or refreshment, a number of products are aimed at single serve portions, and more specifically single serve portions for children and young adults (hereinafter referred to as "youth" beverages). These packages historically have been in the form of aseptic boxes or bags such as the familiar "juice box". The juice box suffers from its requirement of a straw for dispensing. The straw is an extra component that must be attached to the individual package. The straw has a sharpened end to facilitate initial puncture of the package. Once inserted, the package can be used as a "squirt gun" by squeezing. These latter aspects can result in troublesome situations in group child activities. Finally, because of the multi-material structures, including metals, employed with the juice box, recycling concerns have been advanced.

Another segment of packaging geared to youth beverages are packages intended to supply single service portions of nutritional liquids, primarily milk, in school lunch programs. These familiar packages are typically 8 ounce volumes made of paperboard materials. Since this product is refrigerated, there is no aseptic requirement. These packages suffer from being notoriously difficult to open for a child. The packages are difficult to manipulate, resulting in excessive spillage and mess.

Recently, single service packages suitable for youth beverages have appeared using an actual plastic bottle as the container (referred to as a "youth bottle") rather than a boxes or bags. This packaging offers the promise of easier operation in the hands of minors. The packages are relatively rigid and have a well defined exit orifice for controlled dispensing. Aseptic packaging is not always a requirement. Thus, these plastic bottles are of a single material (typically polyethylene or polyethylene terephthalate (PET)) totally compatible with existing high volume recycling streams and methods. In these cases the bottle materials and manufacturing methods are limited in scope and reasonably well defined. However, the closure for these single service packages can vary considerably.

One possible choice of closure for the single service youth bottle is a standard snap-on or screw-on closure. In these packages, the packaging must be of minimal expense. However, this requirement cannot force a closure design which sacrifices seal integrity and tamper evidence in the interests of economy. Thus, standard closure designs can fail to meet the overall balance of requirements.

Another type of closure system for the single service youth bottle is a membrane which is sealed to the bottle top lip after filling with liquid. Such membranes may incorporate a metal foil for easier, more secure application and secure seal. These foils are relatively inexpensive compared to a conventional closure. However, they do present packaging line difficulties in application. In addition, the heat sealed membranes can be difficult to remove since there is little overhang to grasp.

Removal is especially difficult for a child. The membranes often tear along a roughly diametrical line rather than peeling off the lip, and portions may remain on the bottle lip presenting a hazard.

Thus, there exists a need for improved closure systems for packaging of single service amounts of consumable liquids, especially those products which can be generally classified as "youth" beverages.

DISCLOSURE OF INVENTION

According to one or more embodiments of the invention, there is provided a membrane fitment designed and sized to be inserted into the orifice defined by a container and/or neck finish. Retention structure on the fitment cooperates with complimentary structure on the internal wall of the orifice to secure the fitment within the orifice such that the combination forms an excellent primary seal. Tamper evidence is offered by the normal requirement for initial membrane removal. As a result of the substantial reduction in material required compared to a conventional closure, and the ease of push-on application (similar to a cork) final package costs are minimized without sacrifice in sealing or tamper evidence. Novel designs for the membrane, its associated pull ring, and the frangible removal structure are taught. The novel designs promote facile initial removal suitable for a child. In addition, the novel designs avoid the potential hazards presented by prior art membranes.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

MODES FOR CARRYING OUT THE INVENTION

Figure 1:
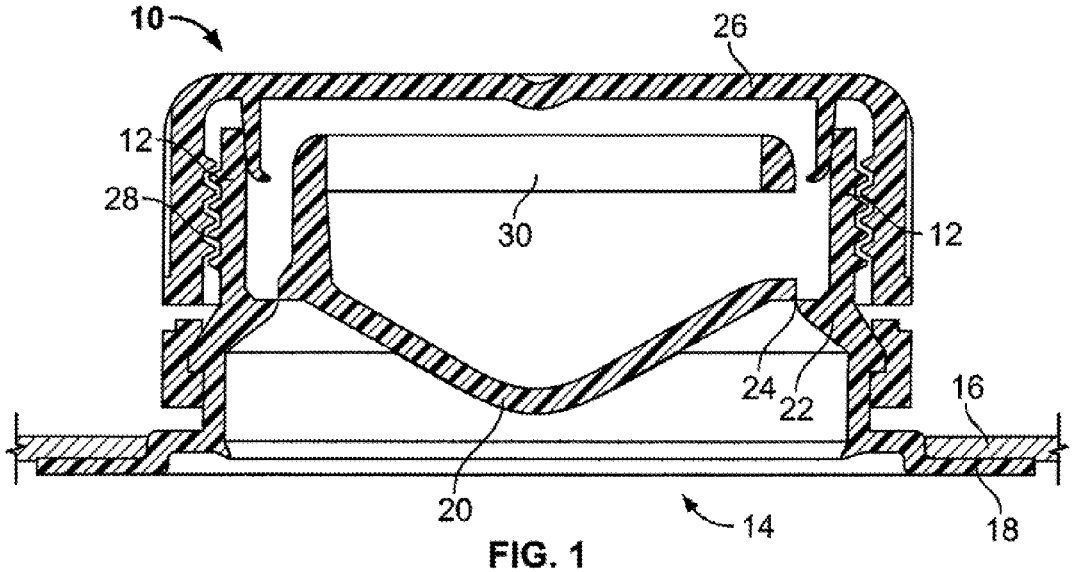
FIG. 1 (Prior Art)
FIG. 1 is a sectional view of a prior art assembled membrane fitment suitable for application to a paperboard carton or beverage bag.

The aspects of the instant invention will now be described in detail in conjunction with the descriptive figures. While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring to FIG. 1, there is shown in section a prior art removable membrane fitment 10 suitable for use on a panel of a paperboard carton or flexible bag. The fitment comprises an upstanding spout 12 surrounding an orifice 14 in the wall panel of carton 16. The fitment 10 includes a flange 18, which allows attachment to the carton sidewall as shown by known techniques such as ultrasonic welding. Approximately midway up the height of the spout, a membrane 20 closes off the orifice defined by the spout. Membrane 20 is attached to an annular projection 22 extending inwardly from the sidewall of the spout. The attachment of the membrane 20 to the annular projection 22 is through a frangible line of weakness 24. An overcap 26 is positioned on the spout 12 and attached thereto by mating threads 28 as is known in the art.

During use the fitment 10 of FIG. 1 is first opened by removing the overcap to reveal the membrane 20, which is initially sealing the orifice 14 of the spout 12. The consumer grasps pull ring 30 and pulls upward to rupture the frangible line of weakness 24 and allow removal of the membrane 20. After the product has been dispensed, the orifice 14 can be resealed by reapplication of the overcap 26. Further details of the structure and operations involving such prior art fitments can be found in U.S. Pat. No. 5,810,184.

Figure 2:
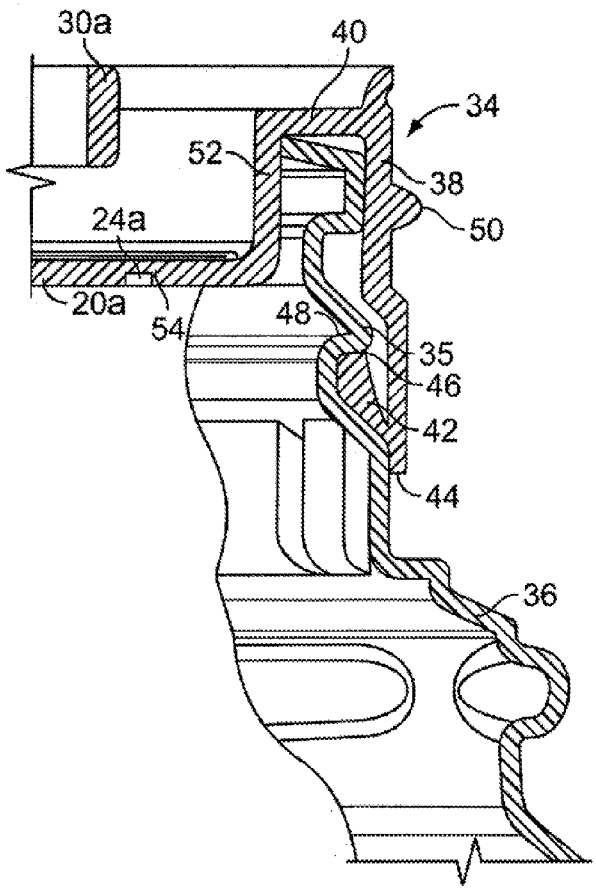
FIG. 2 (Prior Art)
FIG. 2 is a sectional view of a portion of a prior art membrane fitment designed for use with a bottle and shown as applied to a bottle.

Referring now to FIG. 2, there is shown another form of prior art fitment, generally identified in FIG. 2 by the numeral 34. In the FIG. 2 embodiment, fitment 34 is mounted to the neck 35 of a bottle 36 as shown. Fitment 34 includes an outer skirt 38 depending from an annular top 40. An upwardly/inwardly directed annular rim 42 is connected to the skirt 38 proximal its bottom edge 44. The free end 46 of rim 42 abuts a downward face ledge 48 positioned on the outer portion of the container neck 35. The interaction of rim 42 with ledge 48 functions to securely retain the fitment 34 on the bottle neck 35. Outer skirt 38 also includes thread structure 50 positioned on its exterior surface. This thread 50 is designed to mate with the complimentary threads of an overcap (not shown in FIG. 2) in a manner similar to that of FIG. 1.

Continuing to refer to FIG. 2, fitment 34 is also seen to comprise an inner skirt 52 depending from the annular top 40. Inner skirt 52 merges with an essentially horizontal annular structure 54. A membrane, identified in FIG. 2 by numeral 20*a*, is connected to structure 54 through frangible line of weakness 24*a* sealing the orifice 14. A pull ring 30*a* is attached to the membrane 20*a* (attachment not shown in FIG. 2). In a fashion similar to that of the FIG. 1 embodiment, initial opening is accomplished by pulling up on the pull ring 30*a* to rupture the line of weakness 24*a* to thereby remove sealing membrane 20*a*.

While a specific neck structure 35 is shown in FIG. 2, one will understand that many variations in neck finish structure can be accommodated using such fitments. Further details of the structure, manufacture, and use of the bottle fitments such as shown in FIG. 2 can be found in U.S. Patent Publication 20050092750A1.

Figure 3:
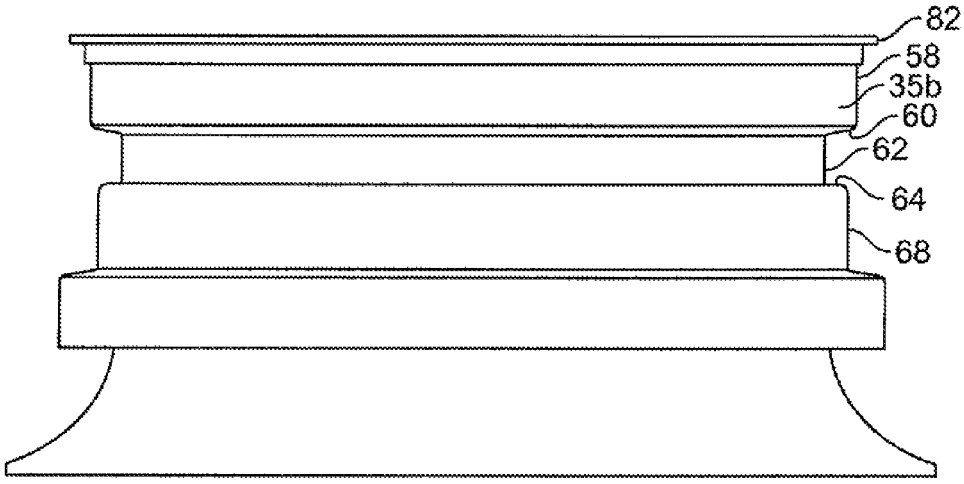
FIG. 3 is a side elevational view of a novel membrane fitment assembly according to the instant invention.

Referring now to FIG. 3, there is shown a side elevational view of an assembly according to one or more embodiments of the invention. The FIG. 3 shows a bottle or container neck finish 35*b*. While not identical to the neck finish 35 of FIG. 2, the neck finish 35*b* of FIG. 3 has many exterior structural features which are similar to features of the FIG. 2 neck finish 35. However, as will be seen in the case of the FIG. 3 embodiment, the embodiment takes advantage of the interior structural aspects of container neck 35*b*. In addition, the same could be used to describe an orifice or opening in a container such as the side or top side of a container for use in carton liquid packaging. The terms "container neck finish" used herein will be defined to include bottle necks, container necks, and/or side container openings.

Figure 4:
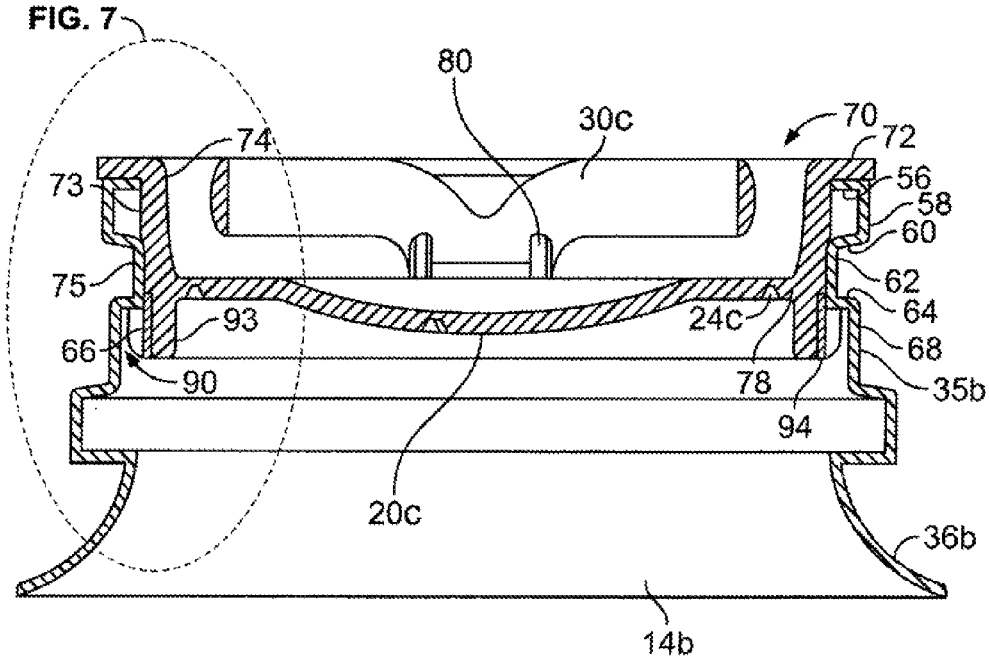
FIG. 4 is a side elevational view in section of the assembly depicted in FIG. 3.

Referring now to FIG. 4, a side elevational view in section illustrates the internal structural features of the FIG. 3 assembly. The container neck finish 35*b* has an annular top surface 56 merging at its outer periphery with vertical stretch 58. At its lower end, vertical stretch 58 joins to an inward directed stretch 60. Another vertically directed stretch 62 extends from the inner peripheral edge of stretch 60 and this stretch 62 connects to an outward directed stretch 64. As shown, outward directed stretch 64 forms an internal downward facing surface or ledge 66. Yet another vertical stretch 68 depends from the outer peripheral edge of the ledge 66. The various structural aspects of bottle neck 35*b* below stretch 68 can take many forms, but those structural forms below stretch 68 are not necessary to the practice of the instant invention.

Continued reference to FIG. 4 shows a dispensing fitment 70 inserted into the bore 14*b* of container neck 35*b*. Fitment 70 comprises a top annular flange 72 which rests on annular top surface 56 and thereby prevents fitment 70 from being pushed completely into the bottle during initial push assembly. Skirt 74 depends downwardly from the inner peripheral edge of flange 72. The outside diameter of skirt 74 is sized slightly larger than the diameter defined by the inner edge of container top surface 56 to thereby achieve a primary seal for the package. In another embodiment it is possible to have another seal defined at an exterior wall 73 of the skirt 74 being positioned against the inner wall 75 of vertical stretch 62. Proximal the lower end of skirt 74, a unique retention structure generally referenced at 90 secures the fitment within the container bore. This retention structure 90 and its operation will be described in detail below with additional reference to FIGS. 5 through 7.

Continuing to refer to FIG. 4, it is seen that an annular projection 78 is positioned on the interior wall of skirt 74 intermediate its top and bottom ends. Removable membrane 20*c* is circumferentially connected to projection 78 through a line of weakness 24*c*. The line of weakness may refer to a continuous line, a series of line segments, score line or score lines, and/or material differences between the membrane and projection or any combinations thereof. Pull ring 30*c* is connected to membrane 20*c* through robust post connections 80. Membrane 20*c* is dished downward to allow easier access of the consumer's finger in grasping the pull ring. In the FIG. 4 embodiment, essentially the entire fitment (with the exception of flange 72) can be contained within the internal space of the container neck. Optionally a peelable label 82 (shown in FIG. 3) is attached to the top surface of top flange 72 to keep the recessed fitment structure clean.

Figure 5:
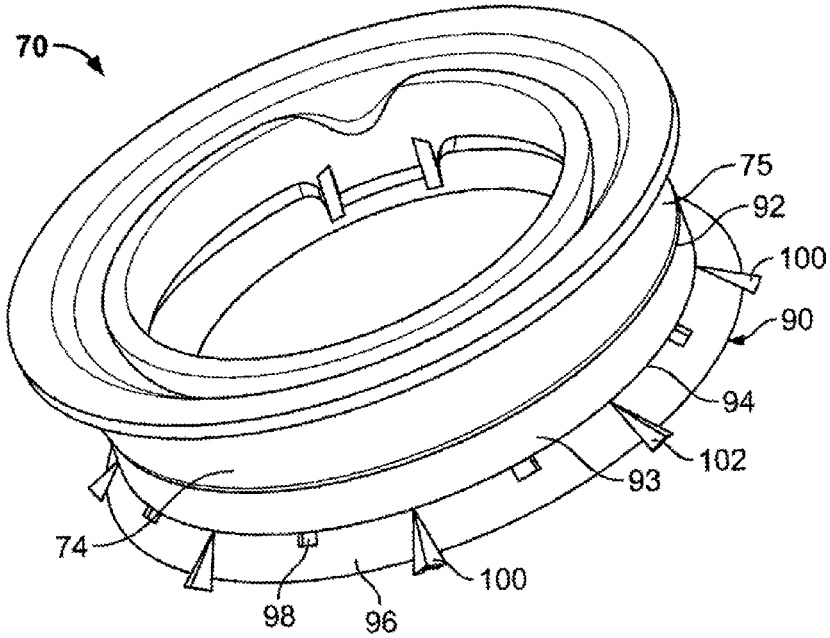
FIG. 5 is a perspective view from above of the fitment of FIGS. 3 and 4.
Figure 6:
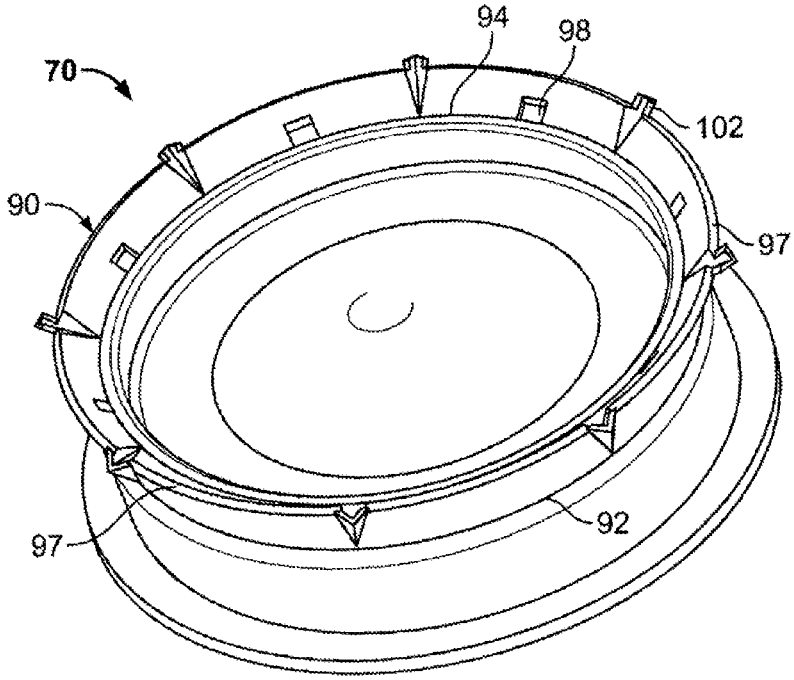
FIG. 6 is a perspective view from below of the fitment of FIGS. 3 and 4.

Referring now to FIGS. 5 and 6 along with continued reference to FIG. 4, the fitment 70 embodied includes retention structure generally designated as 90. FIGS. 5 and 6 show the "as molded" fitment (prior to application to a bottle neck) from top and bottom perspectives respectively. It is seen in FIGS. 4 through 6 that the exterior wall 73 of skirt 74 is recessed inwardly along a circumferential line 92 intermediate the top and bottom ends of skirt 74. Below circumferential line 92 the skirt comprises a lower vertical stretch 93 terminating at a circumferential hinge line 94. Circumferential line 94 is defined and formed by hinge like structure. Structurally, the circumferential hinge line 94 can take many forms, but in the simplest case is a thinned circumferential line.

Fitment 70 further comprises a retaining rim 96. In the "as molded" condition shown in FIGS. 5 and 6, retaining rim 96 generally takes the form of a truncated cone extending downwardly/outwardly from the hinge like line 94 to a free edge 97. One will recognize that retaining rim 96 may be characterized as having a "bi-stable" orientation relative to the fitment 70. It may be pivoted through hinge like line 94 to assume an upward/outward orientation relative to the fitment 70 as will be discussed further with respect to FIG. 7.

In the embodiment shown in the perspective views of FIGS. 5 and 6, rim 96 includes drain holes 98 circumferentially positioned adjacent line 94. These holes prevent retention of fluid contents once the rim is "flipped" to its upward/outward orientation as applied to the container, as will be explained below. Holes 98 also allow more facile movement of the rim between its "as molded" and "applied" orientations.

Continued reference to FIGS. 5 and 6 shows that retaining rim 96 further comprises a number of pleated flutes 100 positioned circumferentially around the retaining rim 96. Flutes 100 have a generally "V" shaped cross section. As best shown in FIGS. 5 and 6, the pleated flutes 100 extend outward past the free edge 97 of rim 96. These flute extensions are identified by the numeral 102.

Figure 7:
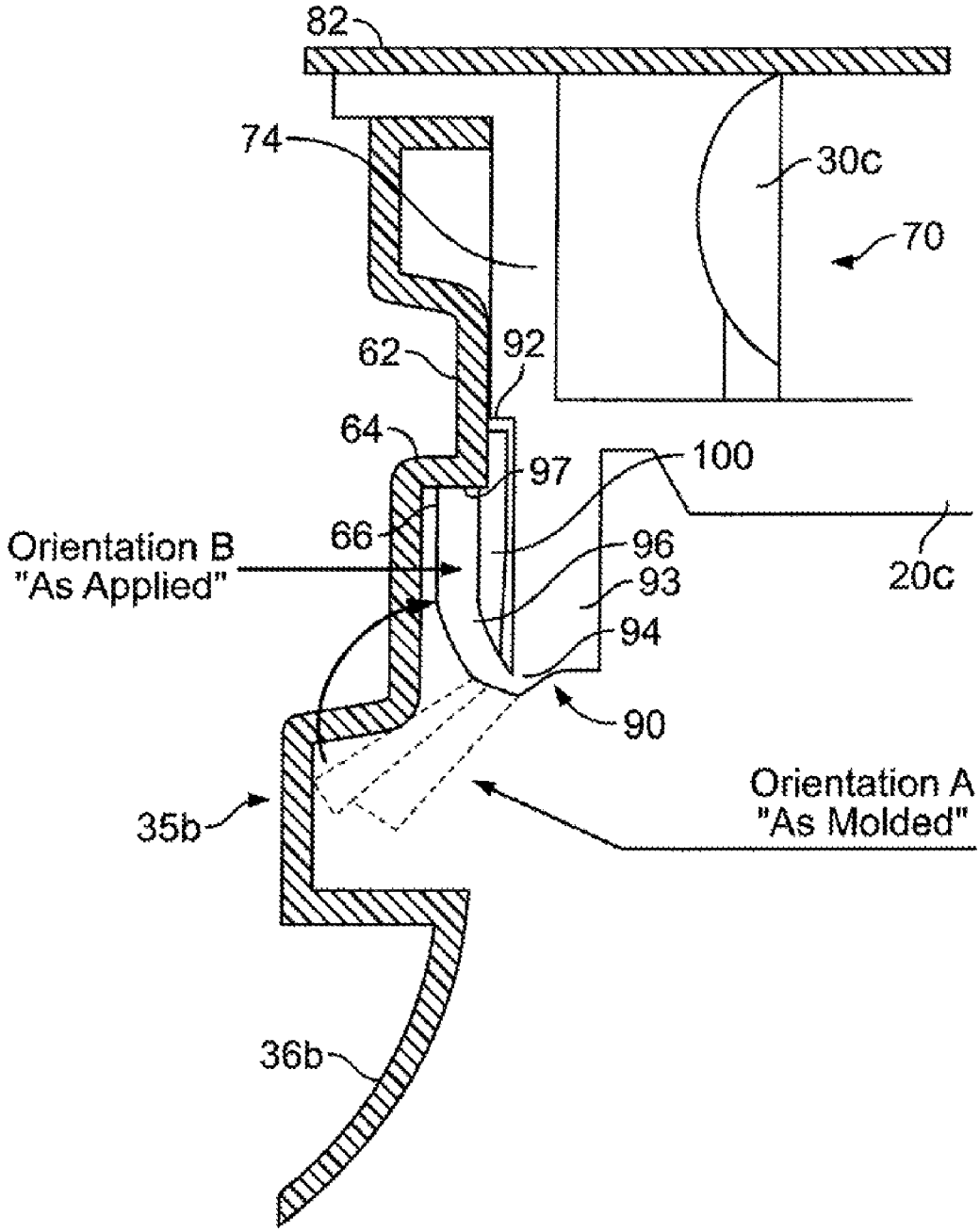
FIG. 7 is a side elevational view of a portion of the view similar to FIG. 4 showing the interaction of retention structure with the interior of the bottle neck bore structure.

Referring now to FIG. 7, there is shown a simplified exploded view of the structure encompassed within the boundary of line 7-7 of FIG. 4. In FIG. 7, section lines have been removed to promote additional clarity of structural details. FIG. 7 shows the retention structure 90. Structure 90 includes the lower vertical stretch 93 of skirt 74, hinge line 94 and rim 96 with its flutes 100. Rim structure 96 is shown in its "as molded" orientation identified as orientation "A" (indicated in dotted lines). Rim structure 96 is further shown in its position as applied to the container, identified as orientation "B". It is understood that orientation "B" is that present when the fitment is applied to the container. Orientation "B" can be achieved by "flipping" the rim to its stable upward/outward directed orientation prior to application to the container. Alternatively, the "flip" from the downward/outward "as molded" orientation to the upward/outward "applied" position can be achieved simultaneously with push on application of the fitment to the bottle neck. In this latter case the diametrical interference between the container structure and the outwardly extending rim will force the rim to its upward/outward orientation during the push on assembly.

Inspection of FIG. 7 clearly shows that, "as applied" the retaining structure of fitment 70 is securely locked onto the interior structure of bottle neck finish 35*b*. Specifically, the free edge 97 of rim 96 lodges against downward facing surface 66 of outward directed container stretch 64, preventing the fitment 70 from upward movement relative to container neck finish 35*b*. In addition the flutes 100 fit snugly within the recessed portion of the exterior surface of skirt 74 below circumferential line 92. The portions of the flutes extending past the free edge 97 also reside within this recessed portion, but are also confined by the interior surface of vertically directed container stretch 62. Proper dimensioning can result in this confinement actually being a "squeeze" to prevent rim 96 from returning to position "A" even if substantial force is applied to remove the fitment from the container bore.

In operation, the bottle 36*b* is filled at the packaging facility and the fitment 70 is simply pushed into the container bore, much like applying a cork or plug. This application securely positions the fitment 70 within the bore of neck finish 35*b*. Upon initial opening the consumer first removes an optional label and pulls pull ring 30*c* to remove membrane 20*c*. Since fitment 70 is intended primarily to achieve dispensing and primary seal for a single service package, there may not be a requirement for a reclosure cap. Nevertheless, one observes from FIGS. 3 and 4 that the exterior structural features of the container neck 35*c* remain exposed by the novel fitment of the instant invention. Therefore, a simple reclosure cap operating cooperatively with the exterior features of neck 35*c* could be readily supplied, possibly as an alternative to the optional peelable label.

One readily appreciates that the novel fitment 70 of one or more embodiments of the invention offers a secure, tamper evidencing primary package seal while minimizing material use and complexity involved with prior art dispensing fitments. Thus, the fitments taught here offer an eminently suitable choice not only for single service packages, but also for larger packages requiring minimal cost.

Figure 8A:
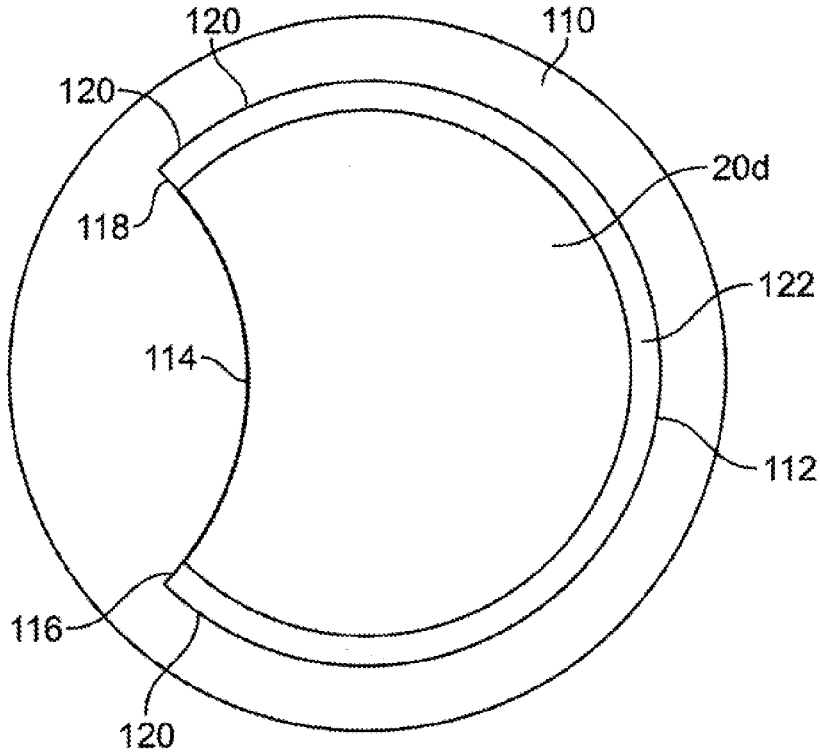
FIGS. 8A through 8F are top plan views showing various designs for the removable membrane portion of fitments according to the invention.

Referring now to FIGS. 8A through 8F, there are shown top plan views of a number of various novel designs for the tear lines and the resulting shape of the removed membranes resulting from removal along the corresponding tear lines. Reference to FIG. 8A shows a generally circular sheet of plastic material identified as 110. The tear line of the FIG. 8A structure combines two arcuate portions 112 and 114. The arcuate tear lines intersect at points 116 and 118. Adjacent these points of intersection, robust posts 120 connect the membrane to pull ring 122. When a consumer pulls upward on the pull ring 122, the membrane 20*d* is removed along the path of the tear line portions.

The structural arrangement shown in FIG. 8A has significant advantages in that it concentrates pull forces dramatically at points 116 and 118 as the consumer initiates pulling. With a conventional round membrane design according to the prior art, a post connects the pull ring to the frangible membrane along and adjacent to a generally arcuate line of weakness. In this case the pull force component is directed in large measure perpendicular to the line of weakness. The force component parallel to the line of weakness, a major contributor to facile tearing of the line of weakness, can thus be quite small at the initiation of tearing. In some cases the parallel forces are insufficient to properly initiate tearing, and the tear start may be quite difficult or in extreme cases the pull ring may pull away without initiating tear. In contrast, the concentration of forces at points 116 and 118 in the FIG. 8A embodiment can significantly improve tear initiation, especially since the arrangement produces initial forces directed parallel to tear line 112 at points 116 and 118.

Figure 8B:
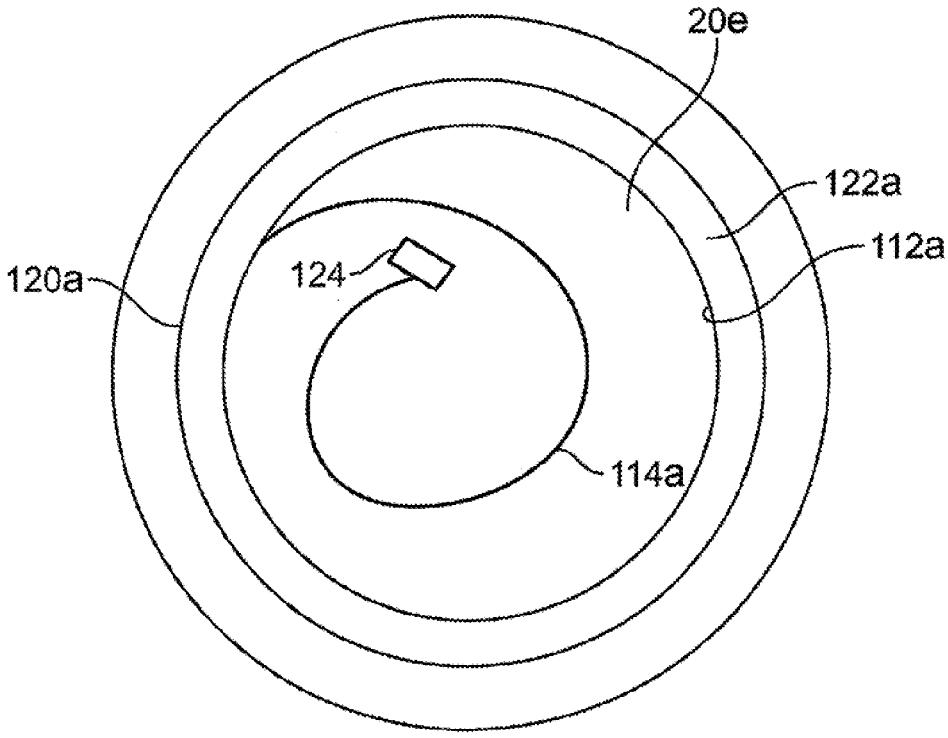

In the embodiment of FIG. 8B, tearing occurs along dual tear lines 112*a* and 114*a*. Both tear lines initiate adjacent post 120*a*. Post 120*a* connects to pull ring 122*a*. Tearing follows both the generally circular line 112*a* and serpentine line 114*a*. The circular tear line 114*a* extends in a complete circle while the serpentine line 114*a* is terminated by thickened section 124. In this case the membrane 20*e* is removed as a strip of material rather than a round disk.

Figure 8C:
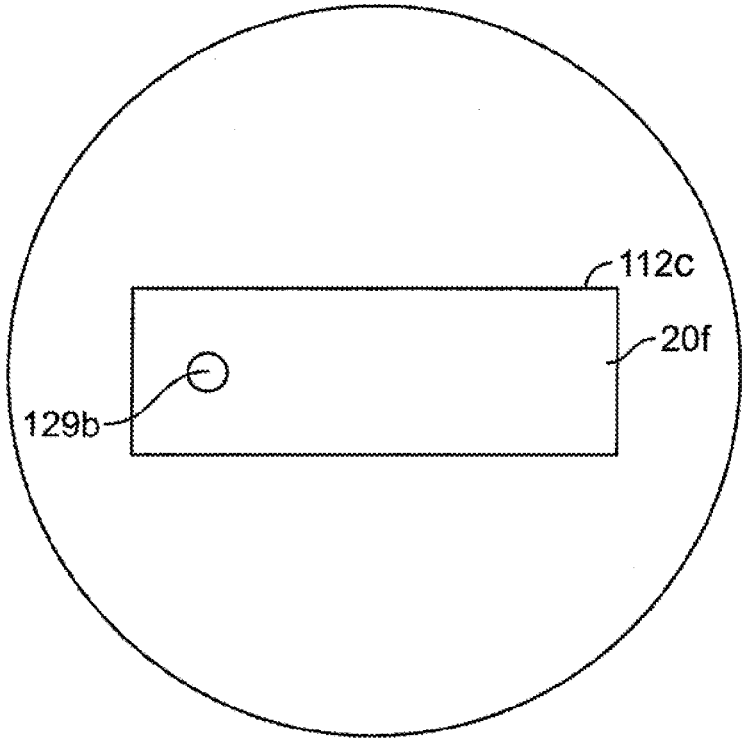

The embodiment of FIG. 8C illustrates the possibility of a rectangular removable membrane 20*f*. In the FIG. 8C embodiment, the pull out membrane section 20*f* is defined by rectangular tear line 112*c*. Robust post 129*b* connects the rectangular membrane 20*f* with a pull ring or tab (not shown in FIG. 8C).

Figure 8D:
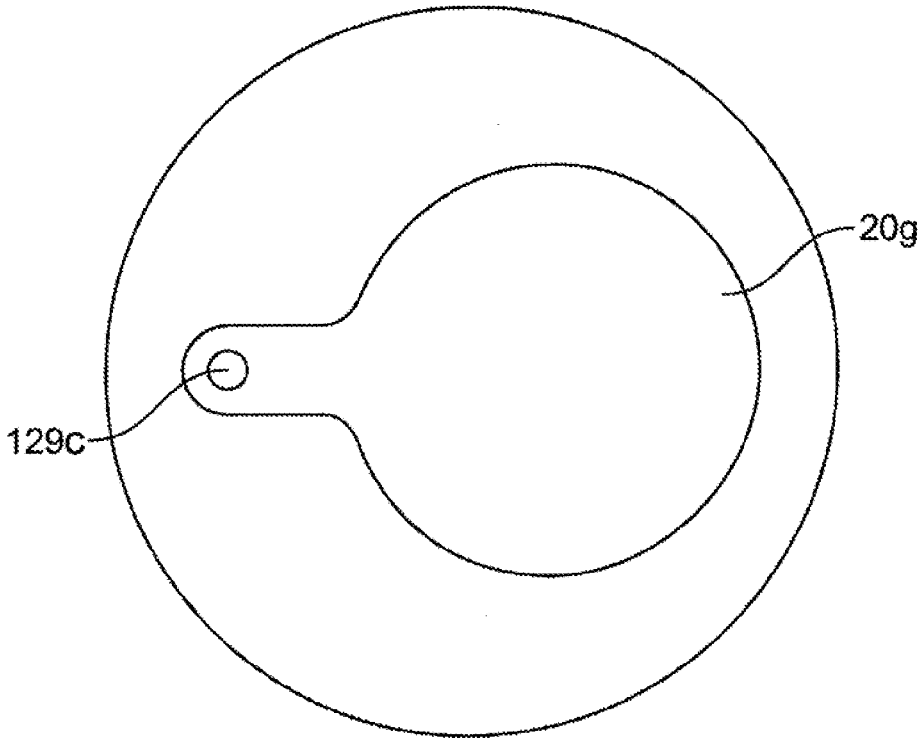

The embodiment of FIG. 8D shows yet another embodiment of removable membrane. In this case the "removable membrane" 20*g* is in the general shape of a frying pan or a paddle. Post 129*c* connects membrane 20*g* to a pull ring (not shown in FIG. 8D). The opening produced by removing membrane 20*g* has the advantage of facile dispensing due to the venting capability afforded by the "handle" portion of the frying pan shape.

Figure 8E:
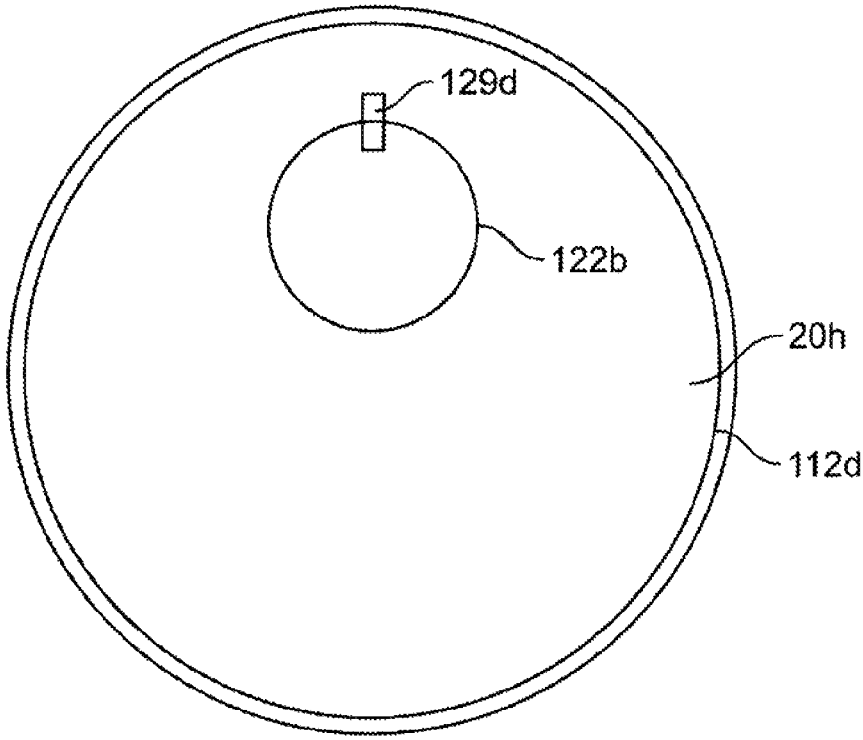
Figure 8F:
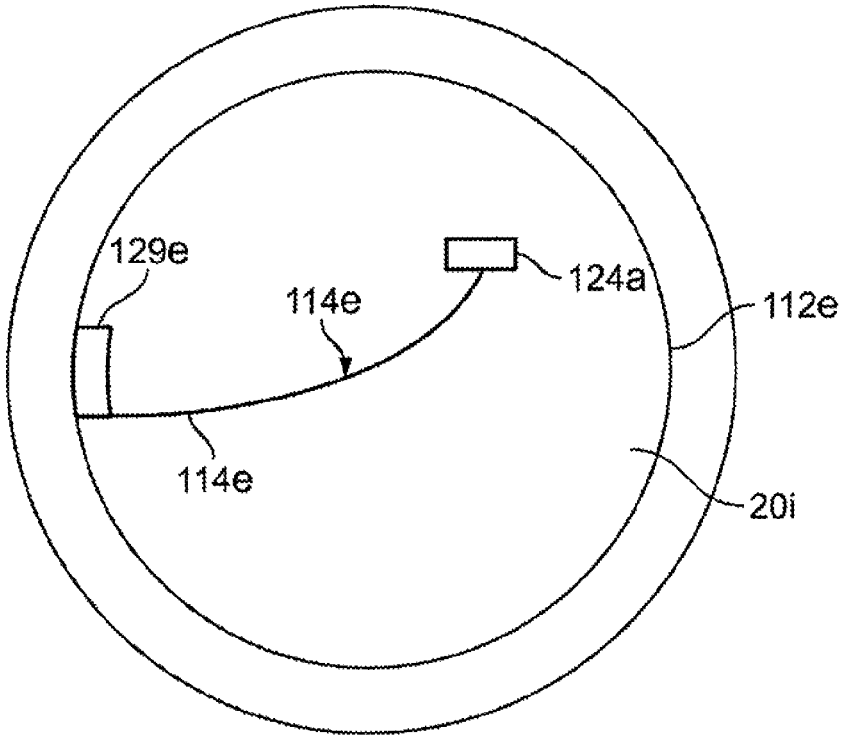

FIG. 8E illustrates the possibility of a pull ring 122*b* of reduced diameter. Pull ring 122*b* is connected to circular membrane 20*h* through post 129*d*. Membrane 20*h* is defined by circular tear line 112*d*. In some embodiments the diameter of the circular pull ring is between 20%-35% of the diameter of the circular membrane FIG. 8F illustrates yet another tearing embodiment. In FIG. 8F, dual tear lines 112*e* and 114*e* initiate adjacent post 129*e*. In a fashion similar to the FIG. 8B embodiment, tear line 114*e* terminates at thickened section 124*a*. Membrane 20*i* is prevented from being a solid disk upon removal, and thus the possibility of a choking hazard is reduced.

Figure 9A:
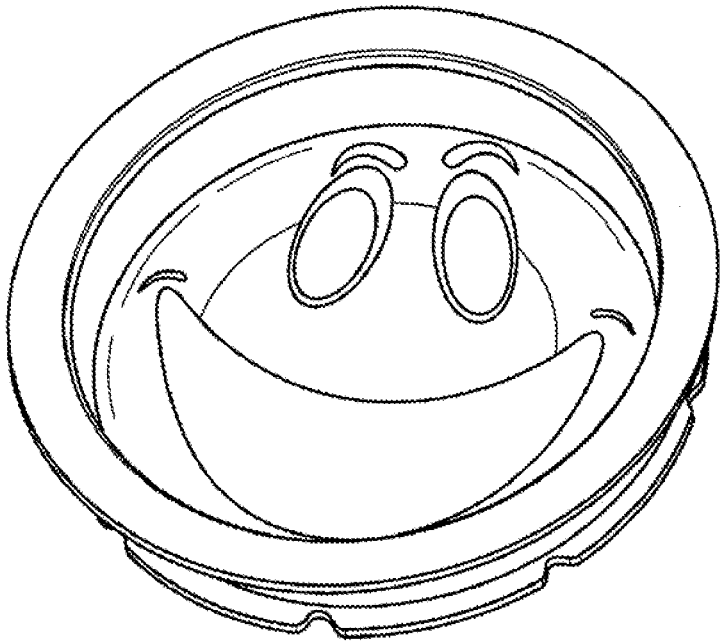
FIGS. 9A and 9B are perspective views of a fitment having a removable membrane similar to that of FIG. 8A and having additional artwork.
Figure 9B:
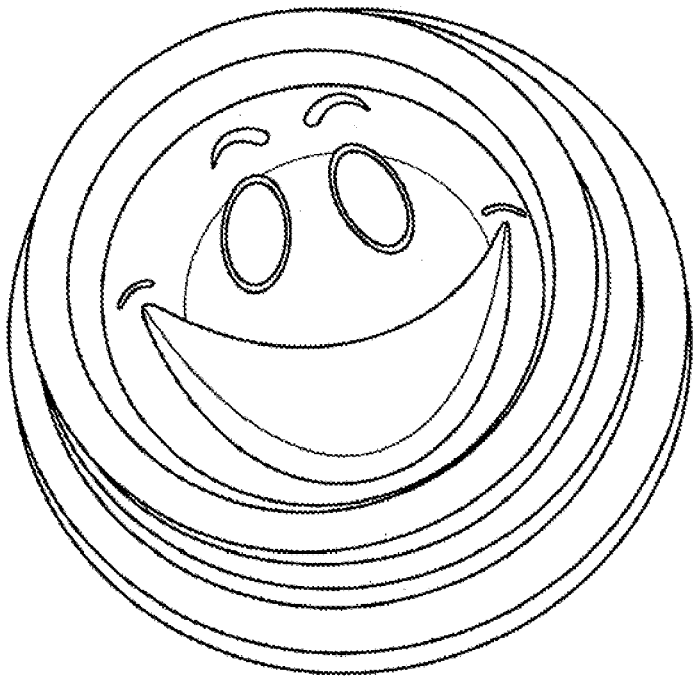

FIGS. 9A and 9B show an example of unique design aspects made possible by creative design of the removable membrane. In the FIG. 9A embodiment, a removable membrane is shaped as the mouth of a well known "smiley face". One recognizes that the removable membrane portion of the FIG. 9A embodiment is similar in design aspects to that of FIG. 8A. The result of removal of the "smiley face" shaped membrane is shown in FIG. 9B, wherein a drinking orifice in the shape of a smiling mouth is achieved.

Figure 10A:
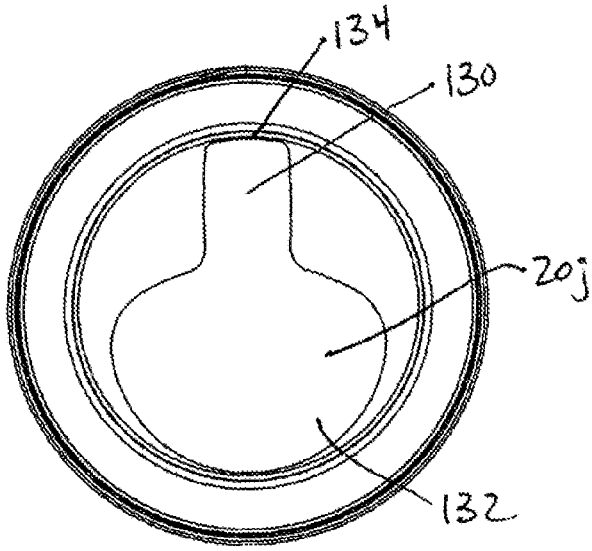
FIGS. 10A and 10B are top plan views of fitments having a removable membrane similar to that of FIG. 8D.
Figure 10B:
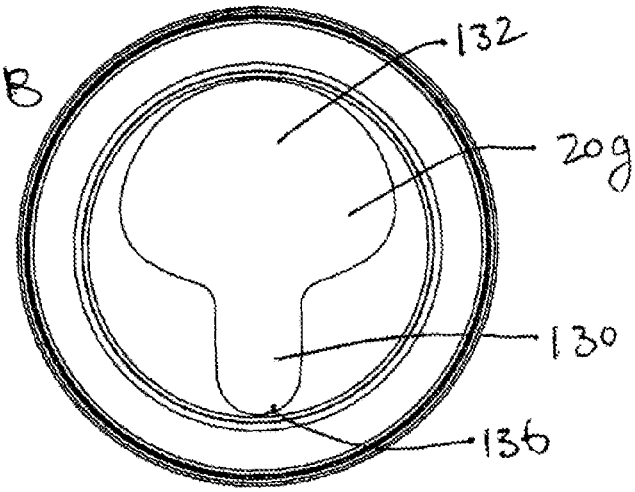

FIGS. 10A and 10B show examples of unique design aspects made possible by creative design of the removable membrane. In the FIG. 10A embodiment, a removable membrane 20*j* is shaped as a paddle having a handle region 130 and a larger head region 132. The handle region 130 having a substantially linear end 134. One recognizes that the removable membrane portion of the FIG. 10A embodiment is similar in design aspects to that of FIG. 8D. In the FIG. 10B embodiment, the substantially paddle shaped removable membrane 20K has a substantially curved end 136 to the handle region 130.

Figure 11:
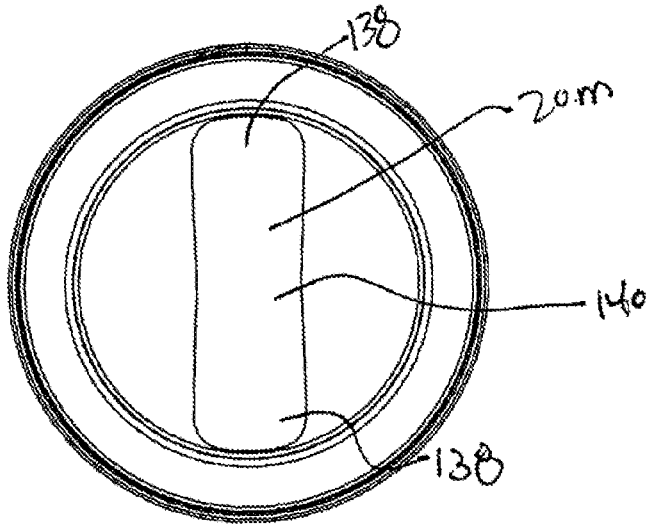
FIG. 11 is a top plan view of a fitment having a removable membrane similar to that of FIG. 8C.

In the FIG. 11 embodiment there is shown a removable membrane 20*m* that is substantially rectangular in shape with having a slightly bowed or tapered shaped towards the mid section of the membrane. Thus the outer ends 138 of the rectangular membrane 20*m* have a longer width than the mid-section 140.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

INDUSTRIAL APPLICABILITY

The subject inventions herein advantageously provide a membrane fitment designed and sized to be inserted into the orifice defined by a container. Retention structure on the fitment cooperates with complimentary structure on the internal wall of the container orifice to secure the fitment within the orifice such that the combination forms an excellent primary seal. Tamper evidence is offered by the normal requirement for initial membrane removal. Novel designs for the membrane, its associated pull ring, and the frangible removal structure are taught in various embodiments. The novel designs may promote facile initial removal suitable for a child. In addition, the novel designs avoid the potential hazards presented by prior art membranes.

We claim:

1. The combination of a fitment used in connection with a container neck finish, the combination comprising:

a container neck finish being connected to or extending from a container having a bore defined through the container finish for expelling contents contained within the container, the container neck finish having an annular top surface that merges at an outer periphery defined by the annular top surface with a first vertical stretch, the first vertical stretch having a lower end that connects to an inward directed stretch, the inward directed stretch having an inner peripheral edge that merges with a second vertical stretch that connects to an outward directed stretch which further forms an internal downward facing ledge, depending from an outer peripheral edge of the ledge is a third vertical stretch; and a dispensing fitment inserted into the bore of the container neck finish, the dispensing fitment having a top annular flange positioned on the annular top surface, the top annular flange having an inner peripheral edge that merges with a downwardly depending skirt, the skirt having an exterior wall to engage at least an inner edge defined by the annular top surface, the skirt further having an interior wall with an annular projection intermediate top and bottom ends defined by the skirt, a removable membrane circumferentially connected to the annular projection through a line of weakness, the removable membrane having a pull ring connected thereto, and the dispensing fitment further having a retention structure hingedly depending from the bottom end of the skirt, the retention structure including a retaining rim having an edge positioned within an area defined by the internal downward facing ledge and the outward directed stretch.

2. The combination of claim 1, wherein the retaining rim of the retention structure further includes at least one drain hole positioned near the bottom end of the skirt.

3. The combination of claim 1, wherein the retaining rim of the retention structure further includes at least one pleated flute positioned circumferentially around the retaining rim.

4. The combination of claim 3, wherein the flutes generally have a V shaped cross section with a portion extending outwardly past the edge of the retaining rim.

5. The combination of claim 1, wherein the retaining rim is generally in the form of a truncated cone.

6. The combination of claim 1, wherein the exterior wall of the skirt is recessed inwardly along a first circumferential line intermediate the top and bottom ends of the skirt.

7. The combination of claim 1, wherein an outside diameter of the skirt has a larger diameter than a diameter defined by an inner edge of the annular top surface defined by the container finish to define a primary seal.

8. The combination of claim 7, wherein the exterior wall of the skirt is further positioned against an inner wall defined by the second vertical stretch to define a secondary seal.

9. The combination of claim 1, wherein the pull ring is connected to the membrane through at least one post connection.

10. The combination of claim 1, wherein the membrane is dished downwardly to allow access to the pull ring.

11. The combination of claim 1 further comprising a peelable label attached to a top surface of the top annular flange of the dispensing fitment.

12. A fitment used for insertion into a bore defined by a container neck finish, the container neck finish further having an annular top surface, an outwardly directed stretch that forms an internal downward facing ledge, and a vertical stretch defined between the annular top surface and the outwardly directed stretch, the fitment further comprising:

a top annular flange positioned on the annular top surface of the container finish, the top annular flange having an inner peripheral edge that merges with a downwardly depending skirt, the skirt having an interior wall with an annular projection intermediate top and bottom ends defined by the skirt, a removable membrane circumferentially connected to the annular projection through a line of weakness, the removable membrane having a pull ring connected thereto; and a retention structure hingedly depending from the bottom end of the skirt, the retention structure including a retaining rim having an edge positioned within an area defined by the internal downward facing ledge and the outward directed stretch.

13. The fitment of claim 12, wherein the skirt further includes an exterior wall to engage at least an inner edge defined by the annular top surface.

14. The fitment of claim 12, wherein the retaining rim of the retention structure further includes at least one drain hole positioned near the bottom end of the skirt.

15. The fitment of claim 12, wherein the retaining rim of the retention structure further includes at least one pleated flute positioned circumferentially around the retaining rim.

16. The fitment of claim 15, wherein the flutes generally have a V shaped cross section with a portion extending outwardly past the edge of the retaining rim.

17. The fitment of claim 12, wherein the retaining rim is generally in the form of a truncated cone.

18. The fitment of claim 12, wherein the skirt has an exterior wall that is recessed inwardly along a first circumferential line intermediate the top and bottom ends of the skirt.

19. The fitment of claim 12, wherein an outside diameter of the skirt has a larger diameter than a diameter defined by an inner edge of the annular top surface defined by the container finish to define a primary seal.

20. The fitment of claim 18, wherein the exterior wall of the skirt is further positioned against an inner wall defined by the vertical stretch to define a secondary seal.

21. The fitment of claim 12, wherein the pull ring is connected to the membrane through at least one robust post connection.

22. The fitment of claim 12, wherein the membrane is dished downwardly to allow access to the pull ring.

23. The fitment of claim 12 further comprising a peelable label attached to a top surface of the top annular flange of the dispensing fitment.

* * * * *